United States Patent [19]

Cooper

[11] 4,296,836

[45] Oct. 27, 1981

[54] SKY SEAT SAFETY DESCENT APPARATUS

[76] Inventor: Thomas F. Cooper, Lisco, Garden County, Nebr. 69148

[21] Appl. No.: 888,573

[22] Filed: Mar. 20, 1978

[51] Int. Cl.[3] ..... A62B 1/00

[52] U.S. Cl. ..... 182/193; 182/7; 182/142

[58] Field of Search ..... 182/3, 4, 5, 6, 7, 142, 182/189-193; 188/65.4, 65.5

[56] References Cited

U.S. PATENT DOCUMENTS

| | | | |
|---|---|---|---|
| 339,647 | 4/1886 | Hargrave et al. | 188/65.4 |
| 771,251 | 10/1904 | Howe | 188/65.4 |
| 916,247 | 3/1909 | Altstadter | 182/7 |
| 3,504,763 | 4/1970 | Rabelos | 182/7 |

*Primary Examiner*—Reinaldo P. Machado

[57] ABSTRACT

A descending manually controllable apparatus slidable on a suspended support rope. Operator sits on supporting structure, controlling the rate of descent.

2 Claims, 2 Drawing Figures

SKY SEAT SAFETY DESCENT APPARATUS

BACKGROUND OF THE INVENTION

This invention relates to safety descent apparatus for use by steeplejacks, repair of any type of high structures, by firemen or for rescue, escape and searching operations.

One use of this apparatus is to go to one floor below fire where persons are trapped. The user of this apparatus can descend while holding a person to bring him safely down. Another use is to descend the side of a structure to make repairs or to paint. A third use is to descend cliffs for prospecting and recreational purposes.

DESCRIPTION OF PRIOR ART

Descent devices and fire escape devices are known which comprise of an anchored flexible line or rope operatively controlling a harness in descent U.S. Pat. Nos. 339,647, 771,251, 916,247 1,351,734, 3,250,515, 3,504,763, 3,532,189.

SUMMARY OF THE INVENTION

An object of this invention is to provide a safety descent apparatus of the character described in which no knots or block and tackle devices are required, and in which a line is secured to a substantial object, or a line is looped around an anchoring object and the descent apparatus is secured to the line by means of placing the line through the nutted D-ring and placing five (5) wraps of line around the post of the chair and through the bottom nutted D-ring. The chair supports the wearers buttocks and is secured to the wearer by means of a safety belt, so the wearer, or operator, can descend while his weight is supported by the anchoring rope.

The operator pulls the free end of the line to stop and feeds the line upward in short increments to allow descent. The operator can move around and work at one level of descent by looping the rope over the locking peg.

A further object of this invention is to provide a strong rugged and safe descent apparatus of the character described which shall be practical, relatively inexpensive, simple to manufacture, easy to use, comfortable for long periods of use and will be highly efficient. This light weight, compact, one piece apparatus has been designed to eliminate the need of several pieces of equipment usually required for descent. The following outline illustrates a few of its many uses;

1. To secure personnel while performing hazardous assignments
2. For escape and rescue purposes
3. Prospecting and surveying
4. Recreation

EXPLANATION OF THE OUTLINE

1. To secure personnel while performing hazardous assignments
   (a) Working on and repairing sides of high structures
   (b) Painting high structures
   (c) Cleaning the insides of smoke stacks
2. For escape and rescue purposes
   (a) Persons trapped by fire or in other hazardous situations can be removed from danger by use of this apparatus
   (b) Eliminates knots and harnesses
3. For prospecting and surveying purposes (a) For prospecting mountains and cliffs for minerals and various strata
   (b) For surveying land in mountainous areas
4. Recreaction
   (a) For use in place of harnesses for descending cliffs and mountains

DESCRIPTION OF THE PREFERRED EMBODIMENT

Figure 1:
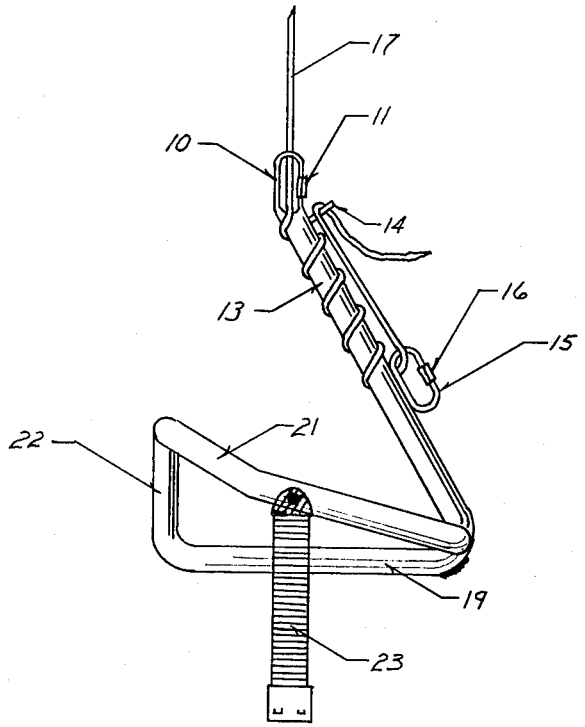
FIG. 1 illustrates a side view of the invention in a working mode. Supporting rope is wrapped around center post and locked through D-rings.
Figure 2:
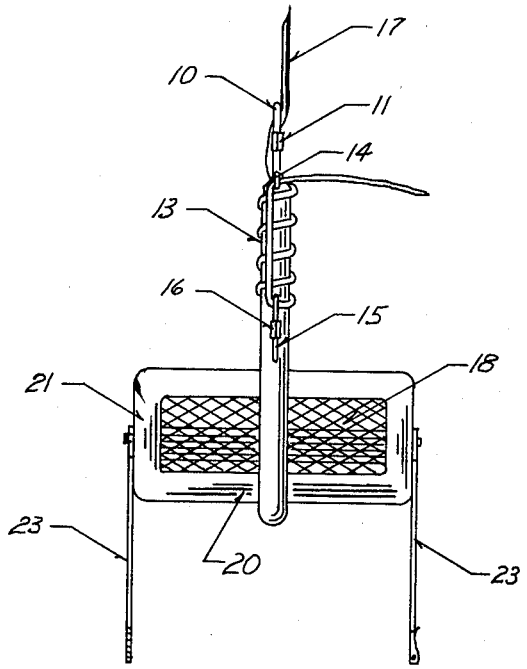
FIG. 2 illustrates a frontal view of the invention in working mode with support rope connected through D-rings and wrapped around center post.

The SKY SEAT consists of the following, starting at the top. A means 10 of confining the support rope 17 connected to the top of the center post 13 in which one side of confining means 10 allows enter and exit 11 of the support rope 17.

Located directly below top confining means 10 is a locking peg 14. Lower end of support rope 17 is looped over locking peg 14 to hold apparatus and operator at a desired height on the support rope 17.

After support rope 17 is locked into top confining means 10 to rope 17 is wrapped around the center post 13 several times and enters lower confining means 15. Lower confining means 15 is attached to front section of the center post 13 and has enter and exit means 16 for the rope 17. Locking device of the confining means 10 and 15, may be obtained by use of a nut type D-ring, spring closure devise or a slide coupler type closure device.

Frame support 19 is an extension of center post 13 which extends under the center of the frame and bends up to support rear frame section 22.

Seat frame comprises of front section 20, side sections 21, and rear section 22. From the top view the seat frame forms a square. Front section 20 is attached to center post 13 below the lower confining means 15. Side sections 21 are bent slightly to form a back rest. Rear section 22 is attached to end of frame support 19.

Safety belt device 23 is attached to frame side sections 21 by an attaching means 24. The safety belt 23 is comprised of two pieces which connect at the ends to hold operator safely and firmly in place.

A material fabric 18 strong enough to support the weight of an operator is attached to the top of seat frame sections, 20, 21, and 22, front sides and rear sections respectively.

I claim:

1. A descent apparatus comprising of a seat frame with an attached center post for retension and descending of a support rope, whereas the said support rope is placed through a confining means at the top of said center post wrapped several times around said center post placed through a lower confining means at the lower portion of said center post and fastened to a tie-off hook attached to said center post directly below top said confining means.

2. A descent apparatus as described in claim 1 whereas the said frame is covered with a material fabric which the operator sits upon while using the apparatus, a safety belt device is attached to the sides of said frame to hold said operator firmly to said apparatus while apparatus is in operation.

* * * * *